US006094817A

United States Patent [19]

Shah et al.

[11] Patent Number: 6,094,817

[45] Date of Patent: Aug. 1, 2000

[54] METHOD FOR FILLING A SILENCER WITH SOUND INSULATING MATERIAL

[75] Inventors: Hiten T. Shah; Tommy E. Rice, both of Delaware; James M. Miller, Pataskala, all of Ohio

[73] Assignee: Acoust-A-Fiber Research and Development, Inc., Delaware, Ohio

[21] Appl. No.: 09/173,117

[22] Filed: Oct. 15, 1998

[51] Int. Cl.[7] ..... B23P 15/00

[52] U.S. Cl. ..... 29/890.08; 29/890.03

[58] Field of Search ..... 29/890.03, 890.08, 29/428

[56] References Cited

U.S. PATENT DOCUMENTS

| | | | |
|---|---|---|---|
| 2,499,018 | 2/1950 | Christiano et al. . | |
| 3,104,732 | 9/1963 | Ludlow et al. | 29/890.08 |
| 3,281,913 | 11/1966 | Morehead et al. . | |
| 3,317,296 | 5/1967 | Irwin et al. . | |
| 3,678,579 | 7/1972 | Slavik . | |
| 3,977,060 | 8/1976 | Ishikawa . | |
| 4,148,676 | 4/1979 | Paquette et al. . | |
| 4,215,805 | 8/1980 | Nielsen . | |
| 5,036,585 | 8/1991 | Schweinfurth | 29/890.08 |
| 5,100,047 | 3/1992 | Nakagawa et al. | 29/890.08 |
| 5,926,954 | 7/1999 | Wolf et al. | 29/890.08 |

*Primary Examiner*—Irene Cuda

*Attorney, Agent, or Firm*—Christen M. Millard; Kremblas, Foster, Millard & Pollick

[57] ABSTRACT

Method of filling a silencer with a sound insulating material includes inserting a nozzle into a silencer and feeding sound insulating material, preferably continuous texturized glass, or basalt, or mineral fiber, through the nozzle into the silencer. The nozzle reciprocates linearly and retracts from the silencer while the fibers are being fed into the silencer. The silencer may be rotated while the sound insulating material is fed into the silencer. The nozzle is reciprocated into and out of the silencer and the silencer rotated clockwise or counter-clockwise to control the density and distribution of fill.

16 Claims, 4 Drawing Sheets

METHOD FOR FILLING A SILENCER WITH SOUND INSULATING MATERIAL

BACKGROUND OF THE INVENTION

1. Field of the Invention

The present invention relates to an apparatus and method for filling a silencer with a sound insulating material. More particularly, the present invention relates to an apparatus and method for filling a silencer with continuous texturized fibers which allow for a uniform filling of the silencer.

2. Description of the Related Art

The basic structure of silencers, such as mufflers used in automobiles, is well known in the art. A standard silencer or muffler includes one or more pipes which pass through a canister. The pipe is often perforated so that gas may pass from the interior of the pipe into the canister. The space between the pipe and the canister is filled with a sound insulating material which silences or muffles the noise caused by the air exhausted from the engine.

It is known in the art to fill a canister with glass fibers. The most commonly used conventional method of filling a silencer involves blowing glass fibers into the canister around the pipe. This type of method is shown in the patents to Ingemansson et al., U.S. Pat. No. 4,569,471, and Broadbelt et al., U.S. Pat. No. 4,774,985. Such a procedure is, however, imprecise. The blowing procedure does not produce mufflers which have a consistent density of fibers in all areas of the canister surrounding the pipe. In addition, the blowing procedure further limits the precision of the silencers made, in that the density of the fibers is not consistent between silencers produced using this process.

Some have attempted to solve this problem by wrapping glass fiber mats around the perforated pipe. This type of process is shown in the patents to Ikeda et al., U.S. Pat. No. 5,461,777, and Tamano et al., U.S. Pat. No. 5,479,706. This tends to correct the problem of the uniform density of the fibers. However, these mats are typically made from fibers which are short (1"–4"). The short length of these fibers leads to more rapid deterioration of the sound absorbing capacity of the silencer compared to using continuous fibers.

Still others have made preforms which are then placed within a canister. An example of this method is shown in European Patent Application No. EP 0692616 A1, by Knutsson. A drawback of this method is that a preform must be made for each type and size of muffler individually. In addition, the fibers are still blown into the preform mold, in a way similar to the Broadbelt and Ingemansson methods, which causes the same problems as mentioned above. Thus, the making of a preform does not solve the current problems in the silencer or muffler area.

What is needed instead is a method and apparatus which allows for uniform filling of a muffler to improve the sound-deadening abilities of the muffler in an economical manner. In addition, the needed method and apparatus must be able to function with continuous fibers in order to reduce the tendency of the insulation of silencers to deteriorate and the shorter fibers to separate from each other and blow out through the exhaust into the atmosphere. The present invention solves these and other problems currently in the art.

SUMMARY OF THE INVENTION

The present invention relates to an apparatus and method for filling a silencer or muffler with a sound insulating material.

Turning first to the apparatus, the apparatus includes a platform or other suitable means which is conformed to releasably mount a silencer. A nozzle is conformed to feed sound insulating material into the silencer. The nozzle is mounted on the platform in alignment with the silencer for linear reciprocating motion into and out of the silencer. A supply of sound insulating material is communicated with the nozzle in a conventional manner.

The sound insulating material may be continuous texturized fibers. If texturized fibers are used, the fibers may be texturized in situ by including in the apparatus a texturizer which is mounted to the platform for texturizing the continuous fibers. The apparatus may also include a cutter for cutting the fibers.

A plurality of nozzles may also be used. If a plurality of nozzles are used, they may be mounted on the platform in fixed relationship to each other. The nozzles may be mounted in a circular configuration and equally spaced from each other. If a plurality of nozzles are used and texturized fibers are used, a plurality of texturizers may be used. The plurality of texturizers may be arranged to correspond with the plurality of nozzles and the respective nozzles and texturizers may be disposed adjacent to one other.

The silencer may be mounted for rotation about a longitudinal axis of the silencer. The circular configuration of the plurality of nozzles may have a center point which corresponds with the longitudinal axis of the silencer.

The method of the present invention for filling a silencer with sound insulating material includes inserting a nozzle into a cavity in a silencer, feeding a sound insulating material through the nozzle into the cavity, and retracting the nozzle from the silencer while feeding the sound insulating material. The sound absorbing material may be cut once the nozzle has been fully retracted from the silencer. As noted above, the silencer may be rotated about its longitudinal axis while performing the feeding and retracting steps.

The method may include texturizing the sound absorbing material. The texturizing may be a texturizing of continuous fibers.

The method may also include turning the silencer 180 degrees and repeating the inserting, feeding, and retracting steps. If the turning step is included, the steps of cutting, rotating, and texturizing may also be repeated.

Figure 1:
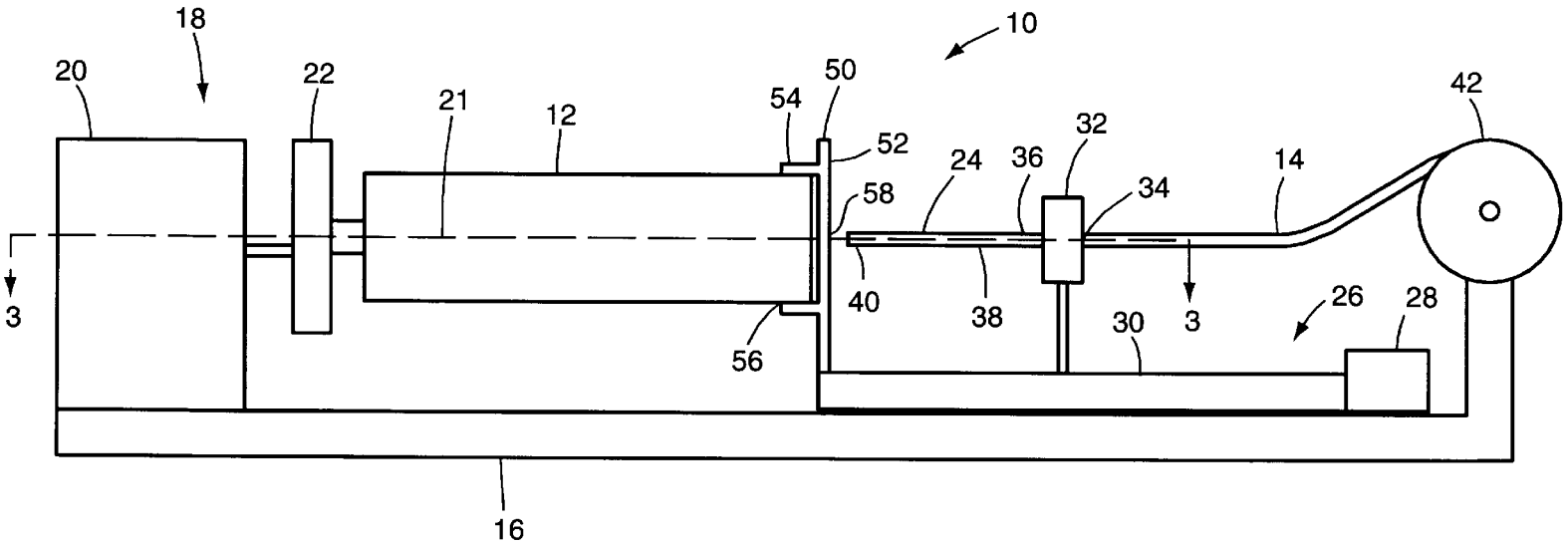
FIG. 1 is a side view of the apparatus of the invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art. In addition, many elements are illustrated which are of a type which perform well known operations. Those skilled in the art will recognize that there are many, and in the future may be additional, alternative elements which are recognized as equivalent because they provide the same operations.

DETAILED DESCRIPTION OF THE INVENTION

The components of the present invention are shown in the drawings. The present invention relates to an apparatus, noted generally as 10, for filling a silencer 12 with a sound insulating material 14. The sound insulating material 14 may be selected from any of the conventional sound insulating materials used for making silencers, but preferably takes the form of texturized fibers. The texturized fibers are preferably made from glass, mineral, polymers, basalt, or ceramics, but are most preferably texturized glass fibers.

Turning first to FIG. 1, the components of a preferred embodiment of the present invention are shown. The apparatus 10 includes a platform 16. It is to be understood that the platform 16 may be a frame to which all the components of the apparatus 10 are secured or any other suitable apparatus for positioning the silencer for the feeding step. However, the components of the apparatus 10 need not be secured to a frame. Instead, they may all be positioned relative to each other on a table or on the floor. Thus, the phrase "mounted on the platform" or "positioned on the platform" may be understood to include the placing of one of the components in appropriate spaced relationship to the other components on an existing substrate. In addition, while the Figs. show the apparatus 10 being positioned on a platform 16 in a horizontal manner, the apparatus 10 and the platform 16 may instead be disposed vertically.

The platform 16 is configured to releasably mount the silencer 12 in any suitable conventional manner, as at 18.

The preferred platform configuration 18 includes a motor 20 and a bracket 22. In this configuration 18, the motor 20 is mounted directly on the platform 16. The bracket 22 rotably links or attaches the silencer 12 to the motor 20 and therefore the platform 16. The motor 20 is used to rotate the silencer 12 about a longitudinal axis 21 (best seen in FIG. 3) of the silencer 12 during the process of filling the silencer 12 with the sound insulating material 14. The motor 20 may be configured to rotate the silencer 12 in either a clockwise or counterclockwise direction. The bracket 22 must be configured to attach the silencer 12 securely to the motor 20 while the motor 20 is rotating the silencer 12, but the bracket 22 must also be configured to release the silencer 12. The bracket 22 may optionally include an ejector (not shown) for automatically releasing the silencer 12 once it has been filled with the sound insulating material 14.

The apparatus 10 also includes a nozzle 24 in the form of an elongate tube which is configured to feed the texturized fibers 14 into the silencer 12. The nozzle 24 is aligned with the silencer 12 and mounted on the platform 16 for linear reciprocating motion into and out of the silencer 12, as at 26. In the preferred embodiment, a motor 28 is attached to a screw drive 30 (best seen in FIGS. 3 and 4). Attached to the screw drive 30 is a plate 32, which is driven by the screw drive 30. The nozzle 24 is fixed to the plate 32. The linear reciprocation of the nozzle 24 is thereby caused by the linear reciprocation of the plate 32 by the screw drive 30. Since the texturized fiber 14 must pass through the plate 32, there must be a hole 34 (best seen in FIGS. 3 and 4) in the plate 32 adjacent to the nozzle 24. The texturized fiber 14 then passes into a first end 36 of the nozzle 24, through the body 38 of the nozzle 24, and out through the second end 40 of the nozzle 24. When the nozzle 24 is inserted into the silencer 12, the feeding of the texturized fiber 14 through the nozzle 24 fills the silencer 12 with the texturized fiber 14.

The fiber 14 may be fed from a supply roll 42 which may be attached to or otherwise disposed adjacent to the platform 16. The fiber 14 is preferably texturized. The texturizing may take place in a number of ways. First, the supply roll 42 may be a roll of fiber which had previously been texturized in a separate operation. It is preferred, however, that the supply roll 42 be a roll of untexturized fiber and that the fiber be texturized in connection with the filling method of the present invention.

Figure 2:
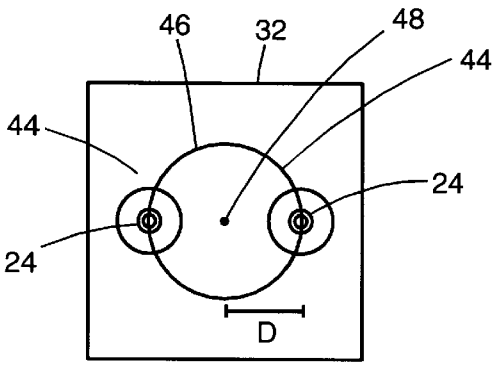
FIG. 2 is an end view of a texturizer and nozzles in the preferred embodiment of the invention.

Turning to FIG. 2, a side view of the plate 32 is shown. As shown, a plurality of nozzles 24 are attached to the plate 32. Forming a part of the plate 32 are texturizing areas 44. The texturizing areas 44 are preferably air jets which function to texturize fibers. These texturizing areas 44 allow the fiber 14 which is fed from the roll 42 to be texturized just before the fiber 14 is fed into the nozzles 24. If a texturizer 44 is used in this manner, it is preferred that one nozzle 24 be attached to the plate 32 or disposed adjacent each texturizer 44. Each nozzle 24 preferably corresponds with a respective one texturizer 44, regardless of the number of nozzles 24 used.

As shown in FIG. 2, the use of two nozzles 24 and two texturizers 44 is preferred. Any number of nozzles 24 and texturizers 44 may be used, but it is preferred that between one and four nozzles 24 be used. Because a typical silencer 12 to be filled using the present apparatus 10 is of limited size, the use of more than four nozzles 24 can cause problems fitting all the nozzles into the silencer 12, due to the standard size of the silencer 12. It is also important that if two or more texturizers 44 and nozzles 24 are to be used, then they are placed in a geometrical configuration which will allow them to be used in connection with filling a standard silencer 12. Since the standard silencer is typically round or oval, the preferred configuration is that the nozzles 24 and texturizers 44 be positioned in a configuration which defines a circle 46 which has a centerpoint 48. The centerpoint 48 corresponds with the central axis 21 of the silencer 12. The radial distance D from the centerpoint 48 to each nozzle 24 depends on the radial size of the silencer 12 which is to be filled. However, the radial distance D should be adjusted in order that each nozzle 24 fits inside the silencer 12.

It is preferred that the present invention be used with silencers 12 which are circular and which have a central pipe. However, it is recognized that some silencers 12 are oval and that the pipe through the silencer 12 may be offset from the center. In such a case, it may be that the nozzles 24 would not be equally spaced from the centerpoint 48 or each other. If the silencer 12 to be filled includes a pipe which is substantially offset from the central longitudinal axis 21 of the silencer 12, it may be desirable to include a nozzle 24 at the centerpoint 48 for more consistent filling. These modifications should not be construed as defining a different invention.

Returning now to FIG. 1, a stabilizer 50 may be used with the present invention. The stabilizer 50 is preferably a plate 52 which includes a bracket 54. The bracket 54 passes on each side of the silencer 12, thereby keeping the free end 56 of the silencer 12 from excessively vibrating while the silencer 12 is rotated. Since the silencer 12 rotates and the stabilizer 50 does not, a coating (not shown), such as TEFLON, may be provided on the stabilizer 50 to prevent friction between the stabilizer 50 and the silencer 12. The stabilizer 50 also may include holes 58 (best seen in FIGS.

3 and 4) with or without bearings which allows each nozzle 24 to pass therethrough. Thus the stabilizer 50 also helps to maintain the spacing of the nozzles 24 within the silencer 12.

In the preferred embodiment, the two motors 20, 28 and the texturizer 44 are powered by air. The use of air is preferred primarily because of its ease of use and availability in a factory setting. The selection of a particular form of motor or texturizer is not critical to the invention, but is merely preferred.

It is also desirable for the present invention to be provided with a number of other features which are not specifically illustrated in the Figs. First, it is desirable for a cutting mechanism to be included. The most preferred configuration is to include a conventional air knife, which is a stream of air which cuts the fibers in the stabilizer 50. However, the cutting mechanism may instead be a die cutter, a knife-style cutter, or a guillotine-style cutter. The use of a cutter in this location permits the fiber 14 to be severed and the filled silencer 12 to be removed after the nozzles 24 fully retract from the silencer 12. This location is preferred, as a cutter placed near the plate 32 would require that the fiber 14 be fed through the nozzle 24 each time the filling process begins, rather than allowing the fiber 14 to remain in communication with the nozzle 24 between the filling of subsequent silencers 12 mounted on the platform 16. In any event, the cutter must be disposed between the silencer 12 and the supply 42 of sound insulating material 14.

In addition, it is preferable to provide a feed system between the supply roll 42 and the nozzle 24. The feed system provides a force which causes the feeding of the sound insulating material 14 through the nozzle 24. The preferred feed system includes a pair of rollers through which the sound insulating material 14 is fed. If multiple supply rolls 42 and nozzles 24 are used, the use of rollers also maintains the two sources 42 of fibers 14 separate from each other.

Figure 3:
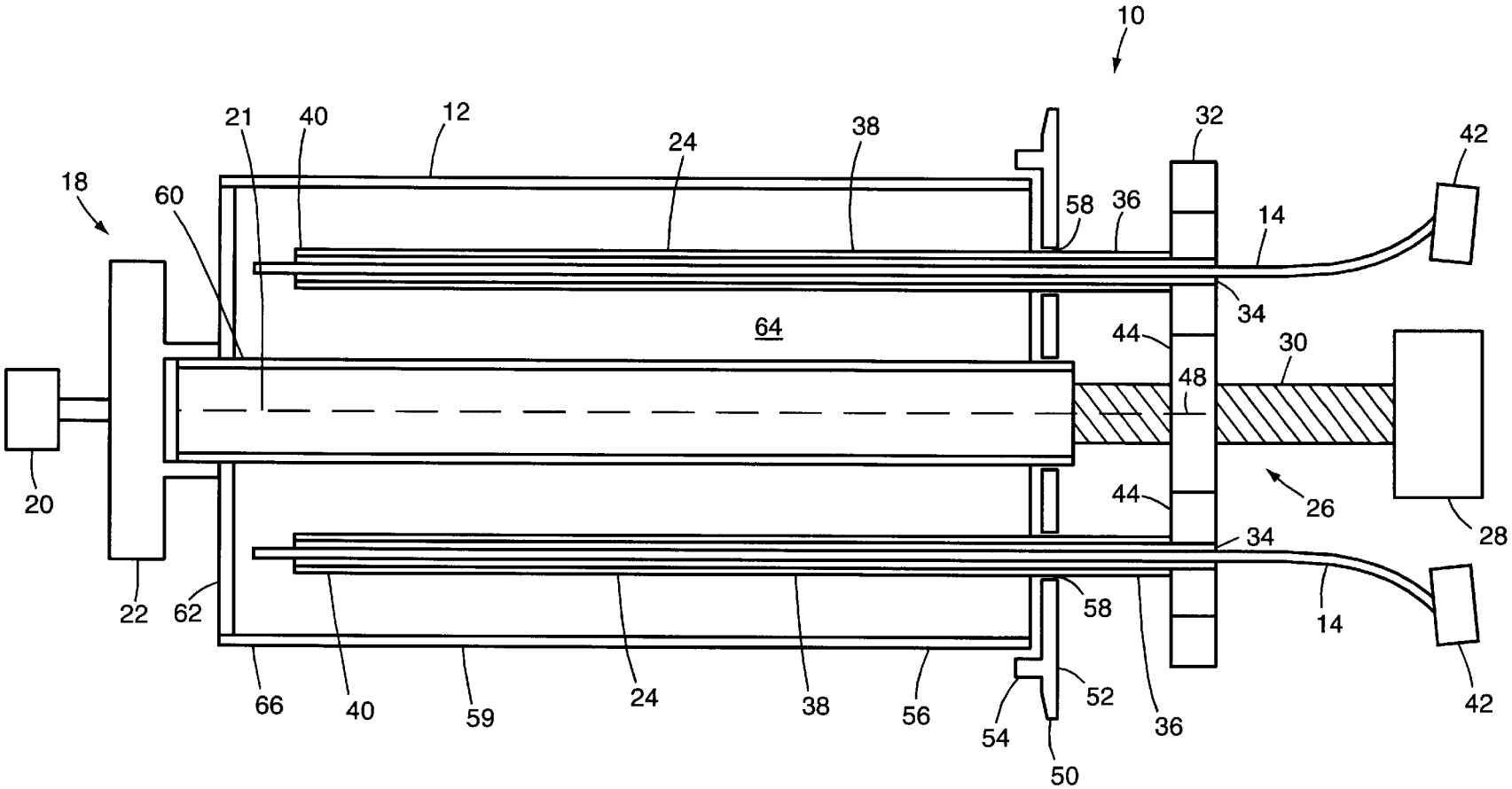
FIG. 3 is a sectional view taken along line 3—3 of FIG. 1, the nozzles being fully inserted into the silencer.
Figure 4:
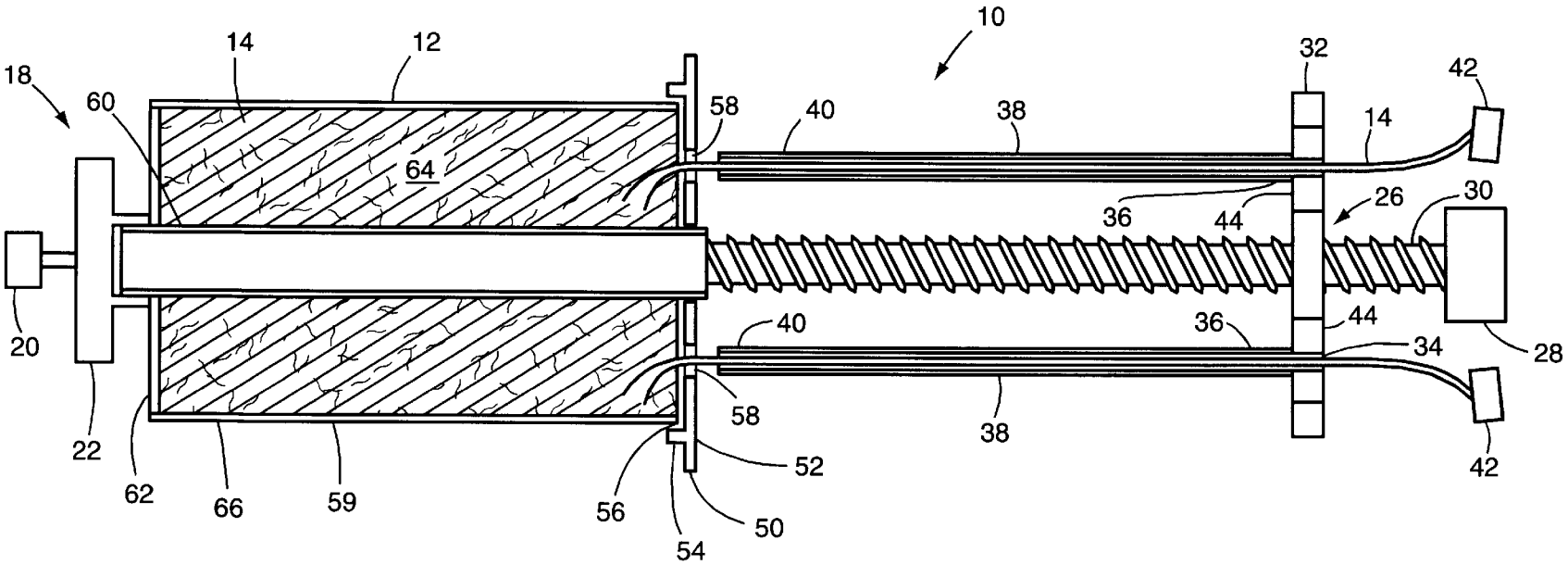
FIG. 4 is a sectional view taken along line 3—3 of FIG. 1, the nozzles being fully retracted from the silencer.

Turning now to FIG. 3, a cross-sectional view of the silencer 12 at the beginning of the filling process is shown. The silencer is shown having a canister 59, a central pipe 60, and an end piece 62. These parts define an annular cavity 64. In FIGS. 3 and 4, the end piece 62 is shown as being permanently fixed to the canister 59 and the central pipe 64. When the present invention is used, it is preferable that the end piece 62 be fixed to the canister 59 and central pipe 64 in order to provide a surface against which the initial length of fibers 14 are deposited. However, the end piece 62 may be merely held in place by the bracket 22 and fixed or attached to the silencer 12 after the filling operation.

As shown in FIG. 3, the nozzles 24 are inserted into the cavity 64 in the silencer 12. It is preferred that the nozzles be sufficiently long to reach substantially all the way to the end plate 62 in the silencer 12. This length is important to allow the held end 66 of the silencer to have an appropriate density of fiber 14 therein, that density being essentially uniform through the entire length of the silencer 12.

Then, substantially simultaneously, (1) the fiber 14 is fed through the texturizer 44 and nozzle 24 and into the silencer 12; (2) the motor 20 rotates the silencer 12; and (3) the motor 28 rotates the screw drive 30, thereby retracting the plate 32 and the nozzles 24 toward the free end 56 of the silencer 12. As the nozzles 24 retract and the silencer 12 rotates, the fiber 14 becomes wrapped around the pipe 60. Controlling the rate of fiber feed and the linear rate of retraction of the nozzles 24 provides a more uniform deposit of fibers over the length of the cavity 64. The density of the fiber 14 within the silencer 12 can be adjusted by adjusting the rate at which the fiber 14 is fed into the silencer 12 and by adjusting the rate at which the nozzle 24 is retracted.

FIG. 4 shows the present invention after the nozzles 24 have been fully retracted from the silencer 12. The fiber 14 is wrapped around the pipe 60 and fills the cavity 64 of the silencer 12. The fiber 14 is severed by a cutter (not shown) . The silencer 12 can then be released from the bracket 22 and another silencer 12 can be inserted onto the bracket 22.

The nozzles 24 may be inserted and retracted as shown several times. It is desirable to insert several layers of fibers into the cavity 64, rather than one thick layer. The insertion and retraction may also be only partial. For example, the nozzles 24 may be fully inserted into the cavity 64 for the silencer 12. Then the fiber 14 is fed through the texturizer 44 and the nozzle 24 into the silencer 12, while the motor 20 rotates the silencer 12 and the motor 28 retracts the nozzles 24. When the second ends 40 of the nozzles 24 reaches a designated location, such as, for example, the designated location A (see FIG. 3), the nozzles 24 may then be re-inserted into the cavity 64 to extend substantially all the way to the end piece 62 of the silencer 12. The feeding and rotating may continue during this re-insertion or may be stopped until the nozzles 24 are fully re-inserted. Once the volume of the cavity 64 between the end piece 62 and the designated location A has been filled to an appropriate density, the fiber 14 may be fed and the second ends 40 of the nozzles 24 be inserted and retracted between the designated location A and a second designated location B (see FIG. 3). Once the volume of the cavity 64 between the designated location A and the designated location B has been filled to an appropriate density, the fiber 14 may be fed and the second ends 40 of the nozzles 24 be inserted and retracted between the designated location B and the free end 56 of the silencer 12. These insertions and retractions fill the cavity 64 of the silencer 12.

Many modifications may be made to the particular forms described above. The nozzles 24 may be inserted and retracted any number of times. There may be any number of designated locations A and B between which the nozzles 24 may be inserted and retracted. The density of fibers 14 may also vary along the length of the silencer 12 by varying the number of insertions and retractions of the nozzles 24 between any two locations.

In addition, as mentioned above, there need not be any designated locations A and B. Instead, the nozzles 24 may be inserted into the cavity 64 sufficiently far that the second end 40 of the nozzles 24 extends substantially all the way to the end piece 62. The retraction, rotating and feeding steps can then be performed. When the second end 40 of the nozzles 24 has been retracted at least substantially all the way from the silencer 12, or at least substantially to the free end 56 of the silencer 12, the nozzles 24 may then be re-inserted. This re-insertion of the nozzles 24 may take place while the silencer 12 is being rotated and the fiber 14 fed, or these steps may stop and then the nozzles 24 re-inserted. These steps may then be repeated.

Figure 5:
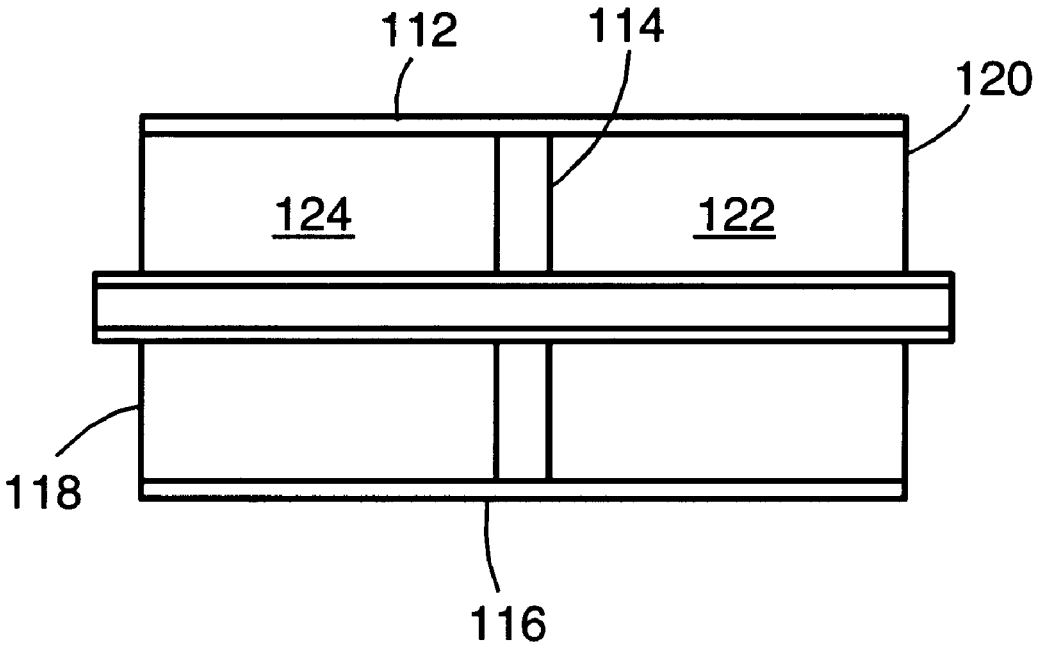
FIG. 5 is a sectional view of a second style of a silencer in connection with which the present invention may be used.

Additional steps may also be desirable. Turning to FIG. 5, in some silencers 112, there is a baffle 114 which exists in the central portion 116 of the silencer 112. The present invention may be used to fill such a silencer 112. The bracket 22 must be modified to engage the first end 118 of the silencer 112 without the use of an end cap. The fiber 14 would then be fed into the second end 120 of the silencer 112. The process for filling this type of silencer 112 is the same as that described above and may include any number of insertion and retraction steps and may also include the use of designated locations A and B. Once one portion of the cavity 122 has been filled with fiber 14 to a desired density, the silencer 112 must be turned to align the other end 118 with the nozzles 24. The process is then repeated by feeding the fiber 14 into the first end 118 of the silencer 112 to fill the second portion of the cavity 124. Steps similar to those mentioned above may be used to fill this portion of the cavity 124. If such a silencer 112 is used, any of the steps and apparatus mentioned above may be used in filling this style of silencer 112, but should be used or performed twice in the filling of this silencer 112.

While certain preferred embodiments of the present invention have been disclosed in detail, it is to be understood that various modifications may be adopted without departing from the spirit of the invention or scope of the following claims.

What is claimed is:

1. A method of filling a silencer with sound insulating material, comprising:

(a) inserting a tubular nozzle into a cavity in a silencer to extend substantially to an end plate of the silencer; and (b) feeding a continuous sound insulating material through the tubular nozzle while retracting the nozzle from the silencer and while rotating the silencer about a longitudinal axis of the silencer.

2. The method of claim 1, further comprising cutting the sound insulating material once the nozzle has been fully retracted from the silencer.

3. The method of claim 1, including controlling the rate of feed of the sound insulating material into the nozzle and the linear rate of retracting the nozzle from the cavity to substantially uniformly fill the cavity with the sound insulating material.

4. The method of claim 1, further comprising texturizing the sound insulating material.

5. The method of claim 4, wherein the texturizing step comprises texturizing continuous fibers.

6. The method of claim 1, further comprising turning the silencer, thereby bringing the silencer again into alignment with the nozzles, and repeating the inserting, feeding, and retracting steps of paragraphs (a), (b), and (c) of claim 1.

7. The method of claim 6, further comprising cutting the texturized fibers once the nozzle has been fully retracted from the silencer.

8. The method of claim 6, further comprising rotating the silencer about a longitudinal axis of the silencer while performing the feeding step defined in paragraph (c) of claim 2.

9. The method of claim 6, further comprising texturizing the sound insulating material.

10. The method of claim 9, wherein the texturizing step comprises texturizing continuous fibers.

11. The method of claim 1, further comprising the step of re-inserting the nozzle into the cavity of the silencer and repeating the feeding and retracting steps of paragraphs (b) and (c) of claim 1.

12. The method of claim 1, wherein the retracting step comprises retracting the nozzle until an end of the nozzle reaches a designated location.

13. The method of claim 12, further comprising re-inserting the nozzle and repeating the feeding and retracting steps of paragraphs (b) and (c) of claim 1.

14. The method of claim 13, wherein the repeated retracting step comprises retracting the nozzle until an end of the nozzle reaches a second designated location.

15. The method of claim 14, further comprising re-inserting the nozzle and again repeating the feeding and retracting steps of paragraphs (b) and (c) of claim 1.

16. The method of claim 15, wherein the again repeated retracting step comprises retracting the nozzle until the nozzle has been retracted at least substantially all the way from the silencer.

* * * * *